United States Patent [19]

Mueller et al.

[11] 4,114,686

[45] Sep. 19, 1978

[54] HOT WATER SYSTEM

[75] Inventors: Paul Mueller; Ray A. Prine, both of Springfield, Mo.

[73] Assignee: Paul Mueller Company, Springfield, Mo.

[21] Appl. No.: 810,026

[22] Filed: Jun. 27, 1977

Related U.S. Application Data

[62] Division of Ser. No. 671,579, Mar. 29, 1976, Pat. No. 4,041,726.

[51] Int. Cl.[2] ..... B22D 19/00; B22C 13/14

[52] U.S. Cl. ..... 165/110; 165/163

[58] Field of Search ..... 165/164, 165, 110, 163; 62/238

[56] References Cited

U.S. PATENT DOCUMENTS

| | | | |
|---|---|---|---|
| 2,456,564 | 12/1948 | Muller | 165/163 |
| 2,888,251 | 5/1959 | Dalin | 165/163 |
| 2,941,786 | 6/1960 | Kuljian et al. | 165/110 |
| 3,196,634 | 7/1965 | Rich | 165/110 |
| 3,228,463 | 1/1966 | Kagi | 165/163 |

*Primary Examiner*—Lloyd L. King

*Attorney, Agent, or Firm*—Rogers, Eilers & Howell

[57] ABSTRACT

This invention relates to a hot water system which utilizes heat from the refrigerant of a refrigeration system to produce hot water. The utilized heat consists of the superheat of the refrigerant vapor, the heat of condensation or latent heat, and part of the sensible heat of the liquid refrigerant. The water passing through a water-cooled condensing unit, which is part of the refrigeration system, is heated to a selected temperature by removal of both the latent heat and superheat and part of the sensible heat from the refrigerant as it passes through the condenser unit. The condensing unit has a water inlet and an outlet between which is connected a hot water storage tank. As the water in the condensing unit is heated by absorption of latent and superheat and part of the sensible heat from the refrigerant passing therethrough, the heated water rises and flows by convection into the storage tank. Eventually the storage tank may fill completely with water of a selected temperature. A temperature responsive flow restriction device, or thermostat, is located between the water outlet of the condenser and the storage tank, which restricts the flow of water below a preselected temperature. The heated water, being lighter than the balance of the water in the tank, will remain stratified at the top of the tank and may be drawn off as needed.

10 Claims, 9 Drawing Figures

FIG. 1.
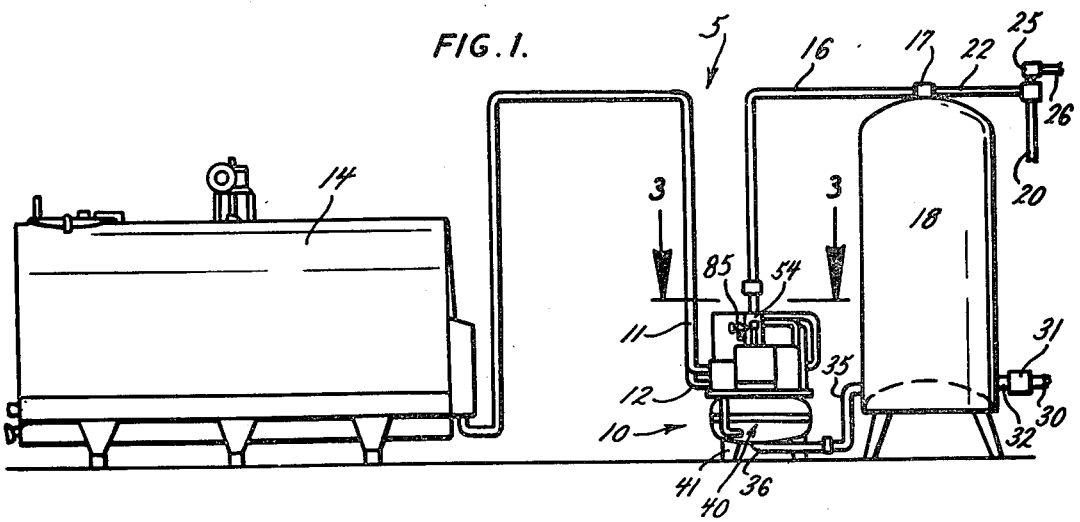
FIG. 2.
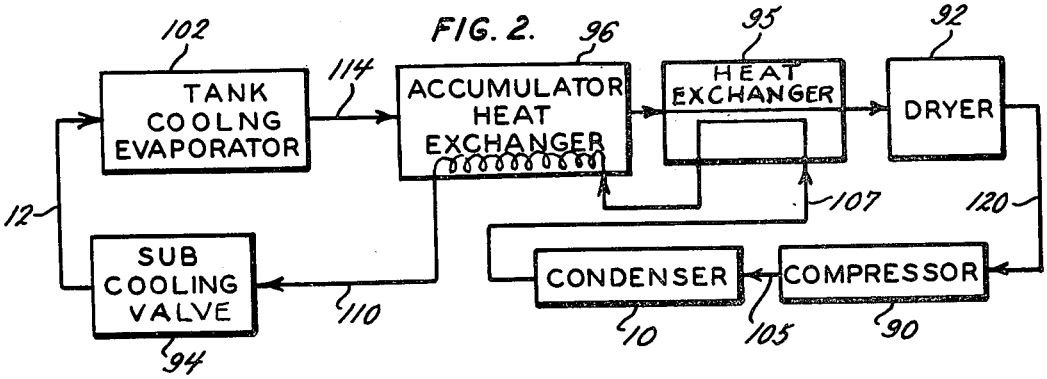
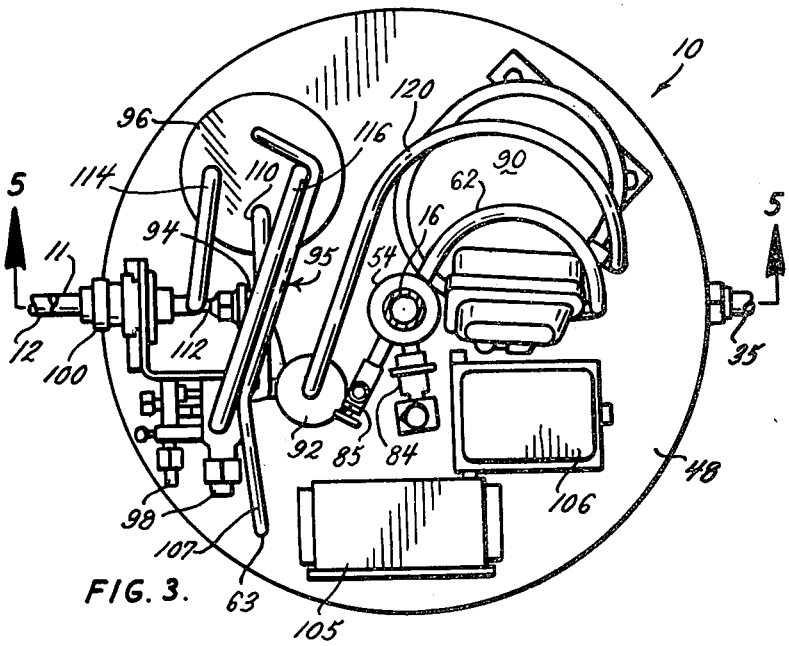
FIG. 3.
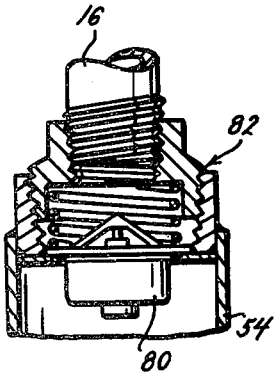
FIG. 4.

FIG. 5.
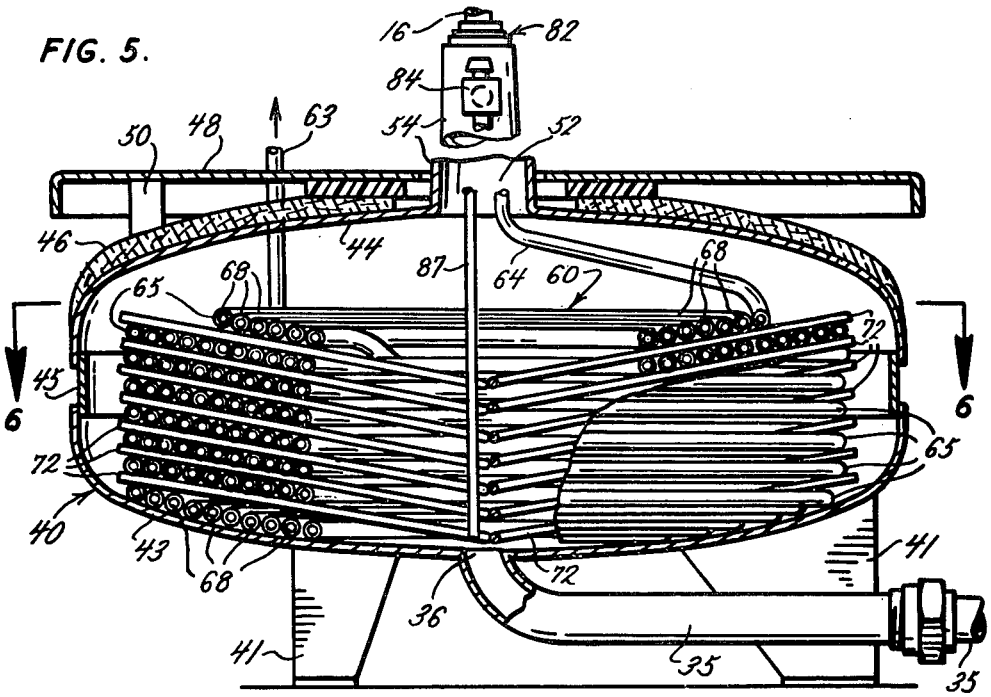
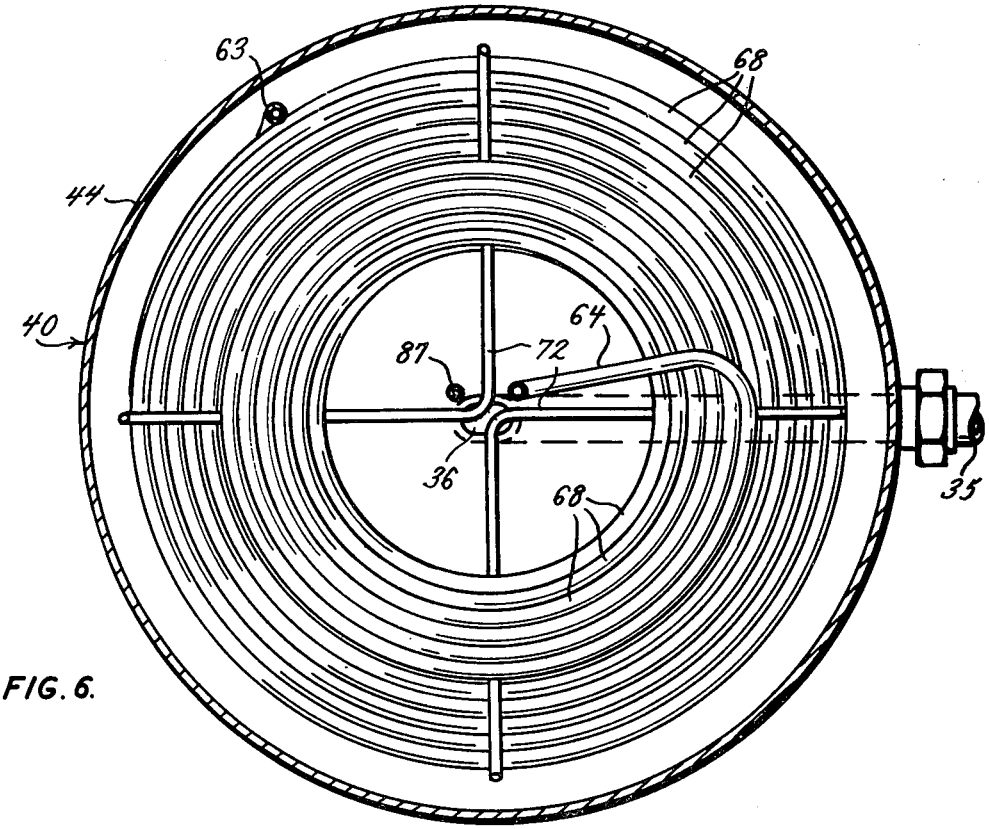
FIG. 6.

FIG. 7.
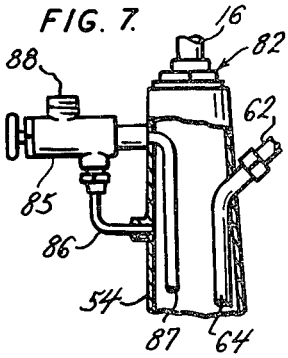
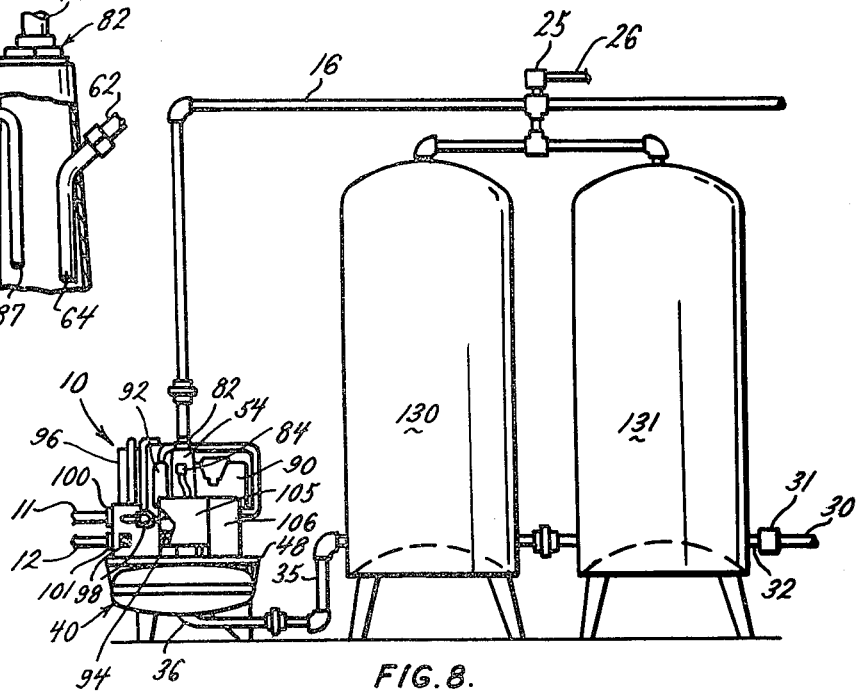
FIG. 8.
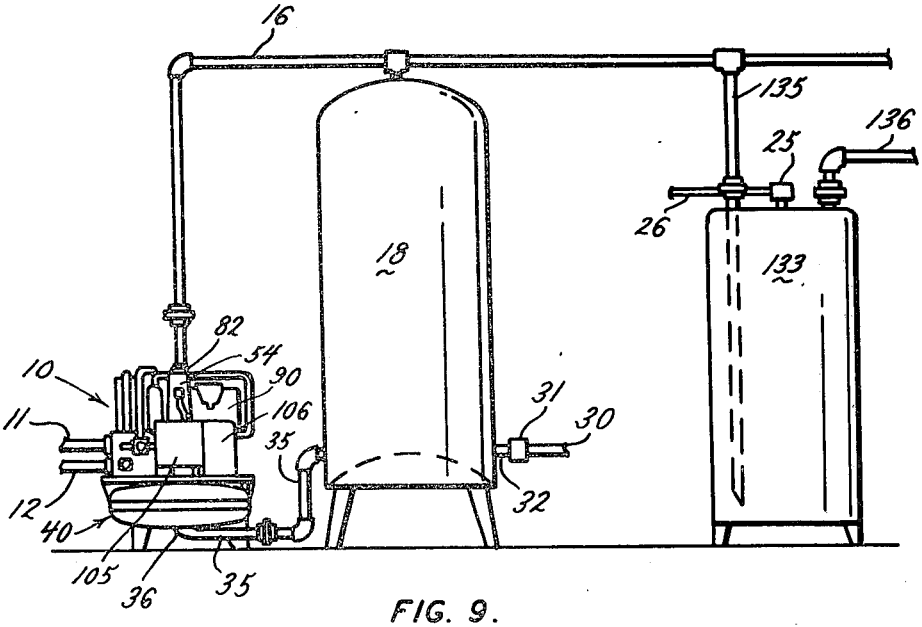
FIG. 9.

HOT WATER SYSTEM

This is a division, of application Ser. No. 671,579 filed Mar. 29, 1976, now U.S. Pat. No. 4,041,726.

BACKGROUND OF THE INVENTION

It is very common to have a refrigeration and/or air conditioning requirement and a simultaneous need for hot water. Generally, the refrigeration system is operated totally separate from the hot water system with the result that the heat removed in the condensing process of the refrigeration system is wasted, while the water in the hot water system is heated by means of an external energy source such as gas, electricity, or oil. The cost of such fuel can be great particularly in situations where large amounts of hot water are required. The purpose of this invention is to reduce or eliminate the need for these expensive fuels and to utilize the heat energy in the condensing process of the refrigeration system to produce the hot water.

A primary example of a situation where refrigeration is used and large amounts of hot water are needed is on the modern dairy farm. Such farms have bulk milk coolers into which the milk from the cows is fed by means of automatic milking devices. The milk is fed directly into the central cooler, or bulk milk cooler, during the milking process. These coolers are refrigerated to remove heat from the milk promptly after it is produced. Thus, the evaporator of the refrigeration system is located in the bulk milk cooler with the other components including the condenser unit located elsewhere. Generally, the condenser unit is air cooled in a conventional manner, or it may be water cooled with much or all of the water wasted. In either case, much of the heat taken from the milk as it is cooled is wasted, and it is a primary purpose of this invention to utilize such heat for the production of hot water.

In addition to requiring a refrigeration system for the prompt cooling of the milk, the modern dairy farm also has a large requirement for hot water at different temperatures. For example, on the same farm, large amounts of hot water are needed for prepping the cows, washing the milk cooler, the pipeline, milker, other components of the milking equipment, and the milking parlor itself. It is also desirable to heat the cows' drinking water in the winter. Water at about 100° F. or so would be used for prepping or cleaning the cows, but much hotter water, about 140° F. to 150° F. is required for cleaning the milking apparatus and cooling tank. Of course, if a large quantity of hot water can be produced at 140° F. to 150° F., it follows that larger amounts of warm water, about 100°, can easily be available. For example, the appropriate water temperature for prepping cows (approximately 100° F.) can be obtained by either mixing the 150° water discharge through the thermostat with cold water by a commercially available mixing device or by removing water ahead of the thermostat before it reaches 150° and tempering it as required with cooler water. The latter is the preferred method since it materially reduces the condensing temperature, thus increases the refrigerating capacity. Thus, a principal object of this invention is to produce large quantities of hot water by utilizing heat absorbed in the condensing process of the refrigeration system.

Generally, in accordance with this invention, the water is heated by transferring the superheat, heat of condensation and a part of the liquid refrigerants sensible heat in a uniquely designed heat exchanger. The heated water then circulates by convection, when the water reaches a selected temperature, into a hot water storage tank where the water remains stratified with the hot water at the top of the tank and the colder water at the bottom. As more water is heated in the condensing unit, the marginal line of stratification in the tank moves progressively lower. The tank may fill completely with hot water at the selected temperature.

The heating of water to produce stratification in a hot water storage tank by means of convection is known in the art. One such construction is known as a "sidearm" heater which consists of a hot water storage tank connected between the inlet and outlet of a heater device. The heater device consists of a coil of copper tubing or the like which is located near the bottom and off to the side of the hot water tank. One end of the tubing is connected to the bottom of the tank and the other end to the top. Of course, an inlet is provided at the bottom of the tank from a cold water supply and an outlet is provided at the top of the tank for the dispensing of hot water. A heating element, such as a gas burner, is located just beneath the heater coil to heat the water in the coil by means of outside energy. In operation, the burner heats the water in the coil which causes the water in the coil to rise by convection and enter the top of the storage tank. The water in the storage tank stratifies until the tank becomes completely full of hot water.

It is also known in the art to utilize some of the heat from the condensing process of the refrigeration system to produce hot water in a storage tank. For example, such a system is described in an article in the June, 1962, issue of "Refrigeration Service And Contracting," page 19.

That article describes a system whereby two units are used, one called a "heat exchanger" and the other called a "final condenser" whereby in the production of hot water at approximately 160° F., the superheat is removed from the refrigerant in the heat exchanger, with the remainder of the latent heat and the subcooling heat being removed at the final condenser. The hot water is produced from the heat exchanger only.

In accordance with this invention, hot water at approximately 140° F. to 150° F. is produced in a single condensing unit by the removal of the superheat, all the latent heat, and in a preferred embodiment part of the sensible heat from the refrigerant in the single unit.

SUMMARY OF THE INVENTION

Generally, the invention comprises a condenser which is part of a refrigeration system, such as used to cool the milk in a bulk milk cooler on a dairy farm. The condenser includes a lower housing containing multiple layers of coils having multiple windings to provide significantly greater heat exchange surface than would normally be provided in such a refrigeration system to accomplish the necessary cooling. The areas between the housing and the coils define a water jacket, and the housing includes a water inlet and a water outlet, the water passing by convection from the inlet, over the coils, where it absorbs both the superheat and the latent heat and part of the sensible heat from the refrigerant passing therethrough, and then through the outlet of the housing. Means are provided for connecting the outlet of the housing to a vertical riser tube in which a thermostat or the like is mounted for restricting the flow of water below a selected temperature. A storage tank has an upper inlet connected to the output of the thermostat and a lower outlet connected to the inlet of the condenser housing. A hot water outlet is provided at the top of the tank and a cold water inlet is provided at the bottom and is connected to a suitable source of cold water.

In a preferred embodiment of the invention, various of the components of the refrigeration system are mounted on top of the condenser housing, and the riser tube extends directly out of the top of the housing. In alternate embodiments, more than one storage tank can be connected in parallel, or a second hot water tank, of conventional design, can be connected in series with the storage tank.

Thus, it is a primary object of this invention to provide a system for producing hot water by utilizing the superheat, the entire heat of condensation or latent heat, and part of the sensible heat in a single condenser of a refrigeration system from which the hot water is produced.

This and other objects of the invention are apparent from the drawings and detailed description to follow.

DESCRIPTION OF THE DRAWINGS

FIG. 1 is a side elevation of a condensing unit of this invention as shown connected in a hot water system of this invention;

FIG. 2 is a schematic, or block diagram, of a refrigeration system of a type used with this invention;

FIG. 3 is a view taken generally along the line 3—3 of FIG. 1;

FIG. 4 is a vertical section through the riser tube portion of the condensing unit showing the thermostat mounting;

FIG. 5 is a view in section taken generally along the line 5—5 of FIG. 3;

FIG. 6 is a view in section taken generally along the line 6—6 of FIG. 5;

FIG. 7 is a fragmentary, partially sectional view of the upper portion of the riser tube.

FIG. 8 shows a modified embodiment of the hot water system of FIG. 1 using two storage tanks in parallel; and FIG. 9 is a modified embodiment of FIG. 1 showing a standard hot water tank in series with the hot water system of FIG. 1.

DETAILED DESCRIPTION OF A PREFERRED EMBODIMENT

Referring to FIG. 1 of the drawing there is shown a hot water system 5 including a condensing unit 10 connected by means of suitable refrigeration conduit 11 and 12 to an evaporator coil (not shown in FIG. 1) suitably mounted in a bulk milk tank 14 in a manner known in the art. The bulk milk tank 14 may be of a type commonly found on dairy farms for the accumulation and cooling of milk from the milking process.

The condensing unit 10 will be described in greater detail, but with reference to FIG. 1 it includes a water outlet connected by means of a water conduit 16 to the hot water inlet 17 at the top of a hot water storage tank 18. The inlet 17 is also connected to a hot water outlet 20 by means of a water conduit 22. A temperature/pressure relief valve 25 is connected to the outlet 20 and to a drainpipe 26 in a manner commonly known and used with standard hot water heaters. The valve 25 is a safety valve to prevent rupture of the tank due to excessive heat or pressure and is generally a requirement on all water heaters.

A source of cold water is connected to the bottom of the tank 18 by means of a conduit 30 which is connected to a check valve 31, the output of which is connected to the cold water inlet 32 of the tank. The bottom of the tank is also connected by means of a water conduit 35 to the cold water inlet 36 of the condensing unit 10.

Referring to FIG. 5, the condensing unit 10 includes a tank or housing 40 with leg supports 41. The tank 40 has a dished bottom portion 43 and a dished top portion 44 welded together or spaced apart and welded to band 45. The top portion 44 is covered with an insulating material such as fiberglas mat 46. A platform 48 is supported on the top of the tank 40 by means of support brackets 50. The cold water inlet 36 is at the center and bottom of the tank, and there is a hot water outlet 52 at the center and top of the tank. A vertical riser tube 54 is connected to the hot water outlet 52.

The major portion within the tank 40 is occupied by the windings of a condenser coil assembly 60 as best shown in FIGS. 5 and 6. The coil assembly 60 is generally one continuous coil having a refrigerant inlet 62 (shown in FIG. 7) and a refrigerant outlet 63 extending above the platform 48. The coil assembly 60 is formed by a vertical tube 64 extending downwardly from the inlet 62 and within the riser tube 54 to multiple layers 65 of windings preferably of copper located in the tank 40, each winding being oriented generally horizontally and having multiple turns 68. The coil layers are held separated by rods 72 formed at 90° as best shown in FIG. 6. It has been found that this coil and housing arrangement makes it possible to provide a large heat exchange surface within the single condenser for removal of all the superheat and latent heat and part of the sensible heat from the refrigerant as it passes through the coil assembly to produce water of a temperature of about 140° F. to 150° F. at the condenser outlet with a maximum water inlet temperature of about 60° F. to 80° F. This is possible due to the unique design wherein the water in the condenser is permitted to stratify and the refrigerant flows countercurrent to the water. In a typical application using refrigerant 22, the hot refrigerant enters the heat exchanger at about 240° F. and meets the water leaving the unit at 145° F. The cold water enters the bottom of the unit at about 60° F. and the liquid refrigerant is subcooled to about 110° F.

A thermostat 80 (FIG. 4), which may be of the automotive type, is mounted in the vertical riser tube 54 just above the inlet 62 of the condenser coil 60 by means of a suitable coupling 82. Beneath the thermostat 80 is a water bypass head pressure valve 84, which is solenoid operated and responsive to excessive head pressure of the refrigeration system compressor to waste water from the hot water system so as to bring colder water into the condensing unit as required.

Also beneath the thermostat 80 is a mixing valve 85 having its hot water inlet connected by a conduit 86 to the riser tube 54 at a location beneath the thermostat, and having its cold water inlet connected to a conduit 87 which extends downwardly within the riser tube 54 and terminates near the bottom of the tank 40 where it receives cold water fed into the tank. The valve 85 has an outlet 88 for delivery of warm water. The drawing of hot water from beneath the thermostat and the mixing of same with cold water in the manner described as warm water is required, increases the relacement rate of hot water with cold water in the tank 40 and thus increases the capacity of the refrigeration system. The refrigerant in the vertical tube 64 helps to heat the water in the riser tube 54 and correspondingly makes the thermostat respond more quickly.

Various components of the refrigeration system are mounted on the support 48. These include the compressor 90, a filter dryer 92, a subcooling valve 94, a heat exchanger 95, and an accumulator/heat exchanger 96. Also included is the appropriate refrigeration conduit for connection of the various components, service valves 98, quick disconnect connections 100 and 101 for making connections from the evaporator coil 102 in the bulk milk tank 14, and appropriate electrical control boxes 105 and 106.

The refrigeration system, for example, may be of the type described in U.S. Pat. No. 3,264,837. The output of the compressor 90 is connected by means of a refrigeration conduit 105 to the input 62 of the condensing unit 10, the output 63 of which is connected by a conduit 107 through the heat exchanger 95 and to an input of the accumulator/heat exchanger 96. The accumulator/heat exchanger 96 is a device commonly known in the art which not only accumulates liquid that might go into the suction line, but also has a heat exchange coil for boiling off the accumulated liquid. Thus, the refrigerant line 107 which passes through the heat exchanger 95 is connected to this coil inside the accumulator/heat exchanger 96, and the output of that coil is connected by a refrigerant line 110 to the input of the subcooling valve 94. The output of the valve 94 is connected by a refrigerant line 112 to the quick disconnect connection 101 and then through that connection and the line 12 to the input of the evaporator 102.

The output of the evaporator is connected by means of the line 11 to the quick disconnect connection 100, and then through a refrigerant line 114 to another input of the accumulator/heat exchanger 96. An output of the accumulator 96 is connected by means of a refrigerant line 116, and through the heat exchanger 95, to the input of the dryer 92, the output of which is connected by means of a refrigerant line 120 to the input of the compressor 90.

Thus, in a preferred embodiment of the invention, the condensing unit 10 includes all of the components of the refrigeration system except the evaporator in the configuration heretofore described.

In FIG. 8 there is shown another embodiment of the invention where the storage tank 18 is replaced with two storage tanks 130 and 131 connected in parallel as shown.

In FIG. 9 there is shown still another embodiment of the invention where a standard hot water heater 133, which is heated from an external source of fuel, is connected in series at the output of the tank 18. The tank 133 need not be described since it is of the standard type commonly known in the art having an inlet 135 and an outlet 136.

OPERATION

With the refrigeration system operating to cool the milk fed into the bulk milk tank 14 during the milking process, cold water at a maximum temperature of about 60° F. to 80° F. and preferably no greater than about 70° F., is fed into the cold water inlet 32 to completely fill the tank 18, the condenser housing 40, and the associated water plumbing so that the system is completely filled with water. When this occurs, the cold water in the housing 40 is heated by absorption of the superheat and latent heat and part of the sensible heat from the refrigerant gas passing through the condensing unit. This heating of the water in the housing 40 continues until the temperature of the water is sufficient to open the thermostat 82. Preferably, the thermostat is set to open between 140° and 150° F. When the thermostat opens, the hot water rises by convection up the riser tube 54 and into the top of the tank 18, causing the cold water in the tank to move downwardly and into the condensing unit where it displaces the water previously heated. As the hot water rises and the cold water enters the bottom of the condensing unit by convection, which is a continuous process, the water in the tank 18 becomes stratified with the hot water at the top and the cold water at the bottom, so that cold water continues to be supplied to the condensing unit. Eventually, the entire tank 18 may become full of hot water at the selected temperature as determined by the thermostat 82.

With the stratification occurring in the tank 18, the condenser is continually supplied with water at a sufficiently low temperature and at convection flow restricted by the thermostat to remove from the refrigerant passing through the condenser all the superheat and latent heat and preferably part of the sensible heat. The condition exists until about the time tank 18 becomes completely full. At this time the water in the condensing unit becomes approximately 140° F. to 150° F., and it is then necessary that either some of the hot water to be drawn from the tank 18, such as during normal usage, or some of the hot water be wasted through the water bypass valve 84 to prevent the compressor head pressure from becoming excessive. Thus, it is important that the hot water storage capacity be sized to receive all the hot water generated during a normal cooling cycle.

The heat exchange capacity of the condensing unit must be sized in accordance with the cooling capacity of the refrigeration system so as to remove all the superheat and latent heat and part of the sensible heat from the refrigerant during the condensing process. It further must be sized to produce hot water, by convection flow restricted by the thermostat, at the condenser output at about 140° F. to 150° F. with a maximum water inlet temperature of about 60° F. to 80° F.

The operation of the mixing valve 85 and associated conduit for producing warm water is as heretofore described.

The operation of the embodiment of FIG. 8 is generally the same as that of the first-described embodiment except that twice the storage of hot water is provided by the two tanks 130 and 131. Such a system would be used where large amounts of hot water are required.

The operation of the system of FIG. 9 is also very similar to the first-described embodiment except that the tank 133, having a standard external heat source, is used to further heat the water from the tank 18 if desired. Also, hot water is provided from the tank 133 during times when the refrigeration system is not operating for any reason.

Various changes and modifications may be made in this invention, as will be readily apparent to those skilled in the art. Such changes and modifications are within the scope and teaching of this invention as defined by the claims appended thereto.

What is claimed is:

1. A condenser comprising a housing having a water inlet and a water outlet, a vertical riser tube, means connecting the lower end of the vertical riser tube to the water outlet of the housing, a coil within the housing defining a refrigerant passage therethrough, said coil having multiple coil layers, said layers being separated to provide water passages therebetween, at least some of the layers having multiple windings, the layers being connected to form a continuous condenser coil with a refrigerant passage inlet at one end and a refrigerant passage outlet at the other.

2. The condenser of claim 1 wherein the horizontal cross section of the housing of the condenser and the shape of the coil are generally annular, the windings of the coil oriented generally horizontally within the housing, said water passage inlet through the condenser being at the bottom of the housing and said water passage outlet of the condenser being at the top of the housing.

3. The condenser of claim 2 wherein said water passage inlet and outlet of the condenser are located on the vertical central axis of the housing.

4. The condenser of claim 1 further comprising a temperature responsive water flow restricting means located in said riser tube.

5. The condenser of claim 4 wherein the lower end of the riser tube is connected at the water passage outlet of the condenser.

6. The condenser of claim 2 further comprising a horizontal platform supported on the top of the housing, and means for mounting other components of a refrigeration system on said platform.

7. The condenser of claim 2 wherein the lower end of the riser tube is connected at the water passage outlet of the condenser.

8. The condenser of claim 4 further comprising a mixing valve having an outlet, a hot water inlet, and a cold water inlet, a conduit within said vertical riser tube for delivery of cold water therethrough, means for connecting the hot water inlet of said valve to said riser tube at a location beneath said restricting means, and means for connecting said conduit to said cold water inlet of said valve.

9. The condenser of claim 8 wherein said conduit has an open lower end located near the bottom of said condenser housing.

10. The condenser of claim 4 wherein said coil includes a tube portion extending vertically within said riser tube and connecting the refrigerant passage inlet with said multiple layers within said housing, said refrigerant passage inlet being located just beneath said flow restricting means.

* * * * *